US008233835B2

(12) United States Patent
Martin et al.

(10) Patent No.: US 8,233,835 B2
(45) Date of Patent: Jul. 31, 2012

(54) SPRING-LOADED, FRICTION-DRIVEN TAKE-UP ROLLER FOR MANAGING LONG SCANNED DOCUMENTS

(75) Inventors: Craig W. Martin, Henrietta, NY (US); Mark A. Nenni, Brockport, NY (US); Guido Dimateo, Ontario, NY (US); Ronald Dews, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 497 days.

(21) Appl. No.: 12/477,974

(22) Filed: Jun. 4, 2009

(65) Prior Publication Data

US 2010/0308097 A1 Dec. 9, 2010

(51) Int. Cl.

| | |
|---|---|
| ***B65H 18/08*** | (2006.01) |
| *G03G 15/00* | (2006.01) |
| *B65H 18/00* | (2006.01) |
| *B41J 15/16* | (2006.01) |

(52) U.S. Cl. ..... 399/375; 400/614

(58) Field of Classification Search ..... 399/375; 242/540, 541, 535.1, 535, 532.1–532.7, 532
See application file for complete search history.

(56) References Cited

U.S. PATENT DOCUMENTS

| | | | | |
|---|---|---|---|---|
| 4,185,760 | A * | 1/1980 | McNew | 226/109 |
| 4,270,911 | A * | 6/1981 | McNew | 493/410 |
| 4,486,093 | A * | 12/1984 | McNew | 355/29 |

FOREIGN PATENT DOCUMENTS

CH 658330 * 10/1986

* cited by examiner

*Primary Examiner* — Judy Nguyen
*Assistant Examiner* — Ruben Parco, Jr.
(74) *Attorney, Agent, or Firm* — Ronald E. Prass, Jr.; Prass LLP

(57) ABSTRACT

This is a take-up roller assembly that is connected to paper exiting a scanner and collects this exiting paper. The take-up roller assembly is moved by movement of paper entering the scanner together with a paper pulling structure that is located in the scanner. This take-up roller assembly is uniquely suitable for use in a wide format imaging system that uses a scanner.

15 Claims, 4 Drawing Sheets

SPRING-LOADED, FRICTION-DRIVEN TAKE-UP ROLLER FOR MANAGING LONG SCANNED DOCUMENTS

This invention relates to electrophotographic marking systems and, more specifically, to paper management, processing and handling used in such systems.

BACKGROUND

While the present invention can be effectively used in a plurality of non-marking, paper-handling apparatus or marking systems such as ink jet printing, non-xerographic printing, etc., it will be described for clarity as used in paper managing and handling of electrostatic marking systems such as electrophotography. In an electrostatographic reproducing apparatus commonly used today, a photoconductive insulating member may be charged to a negative potential, thereafter exposed to a light image of an original scanned document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive area. This image may be subsequently transferred or marked onto a support surface such as copy paper to which it may be permanently affixed by heating or by the application of pressure. Following transfer of the toner image or marking, the copy paper may be removed from the system by a user or may be automatically forwarded to a finishing station where the copies may be collected, compiled and stapled and formed into books, pamphlets or other sets. This invention will be described throughout in reference to paper management and handling both before and after finishing stations. It should be understood, however, that the present invention can be used in any systems where paper is fed, managed or collected.

As above noted, there are many marking systems that transport paper or other media after the paper is marked in marking step or steps. These marking systems could include ink jet printing, electrostatic marking systems, non-electrostatic marking systems and printers or any other system where paper or other flexible media or receiving sheets are scanned, marked and then are transported internally to an output device such as stacking trays or a finisher and compiler station or stations and the subsequent collecting of paper after the scanner completes its functions and the media is marked ready for collection. As above noted, the management-handling system of this invention can be used both before and after finishing stations.

A typical job for customers using wide format products can involve scanning and printing 36-inch wide documents which can be hundreds of feed long (up to 650 feet long). Generally, the portion of the document exiting the scanner (post scan) is sometimes deposited somewhat haphazardly on the floor, the top of the scanner or on a tray requiring further manual handling. This can be costly in terms of the overhead incurred while managing the exiting document and the potential for damage to the original once it has already exited. In addition, in lengthy documents, curling of the unsupported paper can easily occur which could cause subsequent problems. Paper curl can cause poor registration, sheet damage and jamming or poor image quality both before and during further processing such as in a finishing station. Sheets delivered in a curled condition have a tendency to have their edges out of registration with aligning or scanning mechanisms and other sheet-handling systems employed in marking or printing technology.

Therefore, there is a need for improved paper handling in marking or other systems to reduce potential damage to the original or the copy and to reduce paper impairment due to paper curl. Also, since manual collection of scanned rolls of paper has proven to be cumbersome, an automatic handler would be a significant advance in the art.

SUMMARY

This invention provides a mechanism attached to a wide format scanner to which the user can attach the scanned paper as it first exits the scanner (in some applications the scanned paper is hundreds of feet long). This take-up roller would then be lowered into contact with the paper that is entering the scanner, thus producing a friction scanner driven paper take-up mechanism. This would result in rolling the document as it exits the scanner rather than having it fall to the floor or put into a deep collection tray for manual handling. A quick slide-off release mechanism would allow removal of the paper or the take-up roller from the spring-loaded arms upon job completion. A manual approach has been used in the prior art for output lengths as large as 100 feet. The spring load take-up roller described is intended to provide a counterbalance for the loads that would be associated with longer jobs, some as long as 650 feet. The spring force and location(s) at which it is applied would require optimization and potentially adjustment depending on job length.

DETAILED DISCUSSION OF DRAWINGS AND PREFERRED EMBODIMENTS

Figure 1:
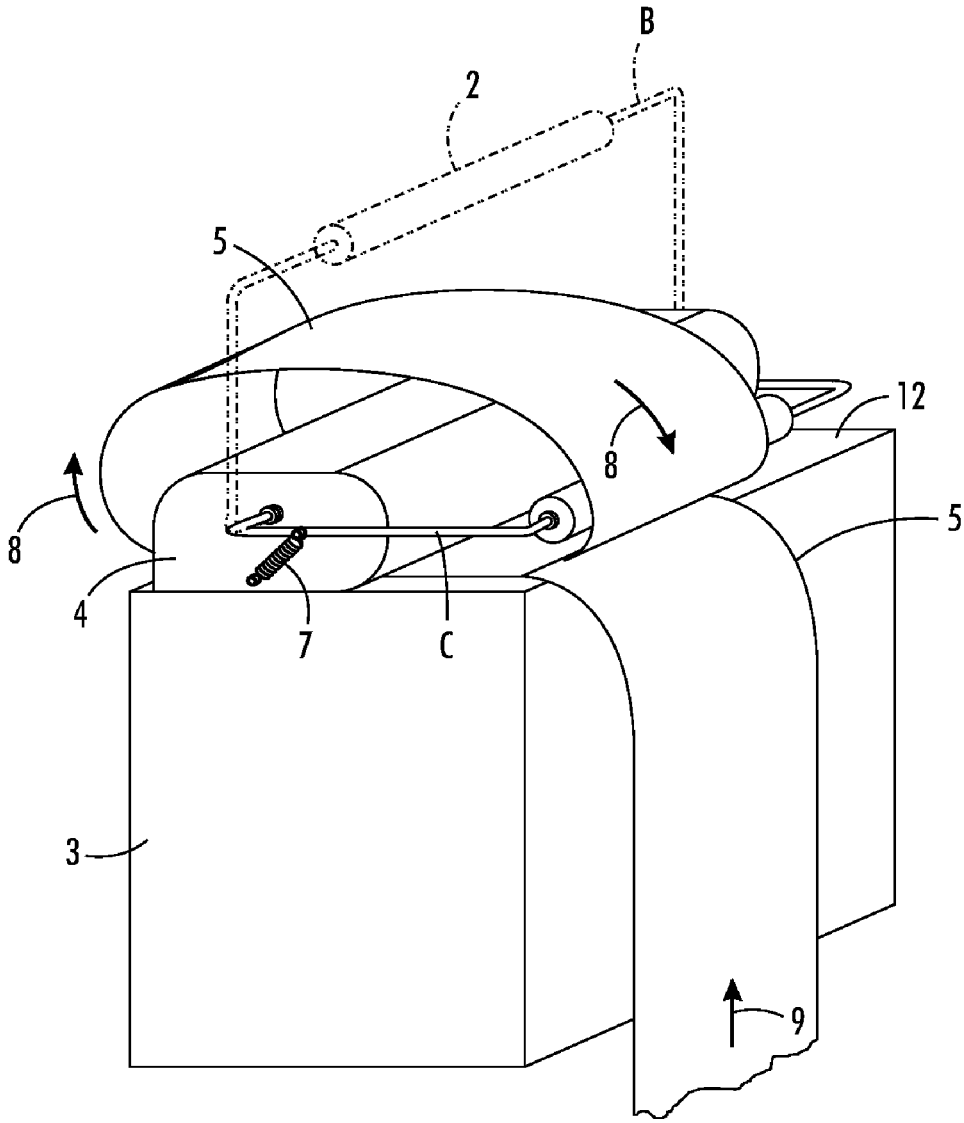
FIG. 1 is a side perspective view illustrating an embodiment of the spring-loaded friction-driven take-up roller of this invention used together with a scanner and printer.

In FIG. 1, an embodiment of the spring-loaded friction-drive take-up roller 2 is shown as it is positioned on a printer housing 3 containing an image output terminal (IOT). On top of housing 3 is a scanner 4 which is configured to receive, scan and output a paper media 5 generally in an embodiment up to 650 feet long and 36 inches wide. The scanner 4 serves as a connection point for the spring-loaded friction-driven take-up roller 2. The disengaged position of the take-up roller 2 is shown at position B. It is at this position that a user connects the paper 5 as it begins exiting the scanner 4. The take-up roller 2 has a slot 6 therein into which the user connects the paper 5 (see FIG. 3). Once the paper 5 is connected to the roller 2, and the roller is in the disengaged position B, the user inserts the long document into the pinch rollers (not shown) of the scanner 4. The user rotates the take-up roller 2 clockwise several times to make sure the paper 5 is on the take-up roller 2 securely and then lowers the take-up roller 2 into the engaged position show at position C. The spring mechanism 7 attached to the sides of the scanner 4 helps to hold the take-up roller 2 in contact with the incoming paper 5 such that consistent friction between the two occurs. The paper 5 exiting the scanner at arrow 8 begins to roll onto the take-up roller 2 at the same speed as the paper entering the scanner at arrow 9. The friction driven take-up roller 2 described herein as applied to very long scanned documents is novel. The beauty of this is that the paper 5 being input to the scanner at arrow 9 drives the device and the mechanism which is self-synchronizing, passive and inexpensive to make. Once the scan operation is complete, the user disengages (B) the take-up roller 2 and uses a "quick release mechanism" to remove the take-up roller 2 and slide the paper 4 off to the left or right. The same quick release allows the take-up roller 2 to be quickly re-installed. The surface of the take-up roller 2 is smooth to facilitate easy removal of paper 5. Obviously, the take-up roller 2 itself must have very low friction such that it rotates easily. In addition, it must be wide enough to accommodate the widest paper that can be scanned.

In a prior art handling system, as the paper exited the back of the scanner, the paper was rolled up (clockwise) and simply laid on top of the paper still entering the scanner. At that point the paper simply rolled up on its own as the scanning process continued. The advantages of the formalization are better handling of large quantities of paper and ensuring that there is a minimum of paper curl and that paper is not re-fed into the scanner. Additional advantages include the fact that no additional powered drive mechanism is required and that the user's document is protected from damage and is kept organized.

No additional powered drive is required to roll the paper around take-up roller 2 because the scanner 4 has power that pulls the paper 5 into the scanner 4 as show at arrow 9, is the same power that causes input paper to turn the take-up roller 2 when it is in the engaged position as shown at C. As the scanner 4 pulls the paper 5 as shown at arrow 9, the pulled paper in turn rubs against the paper exiting the scanner 4 and turns the take-up roller 2 in a roll collecting fashion. Since this paper on the take-up roller 2 is tightly wound around the take-up roller 2, the tendency for paper curl is substantially reduced.

Therefore, a friction driven take-up roller 2 is provided assisted by the scanner 4 pulling power with the input paper pulled by the scanner frictionally moving the take-up roller 2. This is a simple, effective, inexpensive way to collect the outputted paper 5 as it exits the scanner by an assembly that can easily be retrofitted in a paper handling machine.

The slot 6 in the take-up roller 2 is preferably not a tight fit, but just a starting point for rolling the document.

Thus, benefits of this novel assembly of a system propelled take-up roller 2 are numerous, including:

- Paper is not re-fed into the scanner.
- Ease of use (as per the description above).
- Long documents are not damaged as they exit the scanner.
- Competitive advantage at low cost. It is inexpensive and simple to implement.
- Less time spent keeping documents from being damaged. In large print shops where throughput is the lifeblood of the business, the importance of minimizing operator intervention cannot be over-emphasized. This further emphasizes the business relevance of this invention.
- Lastly, problematic paper curl is eliminated or minimized.

Figure 2:
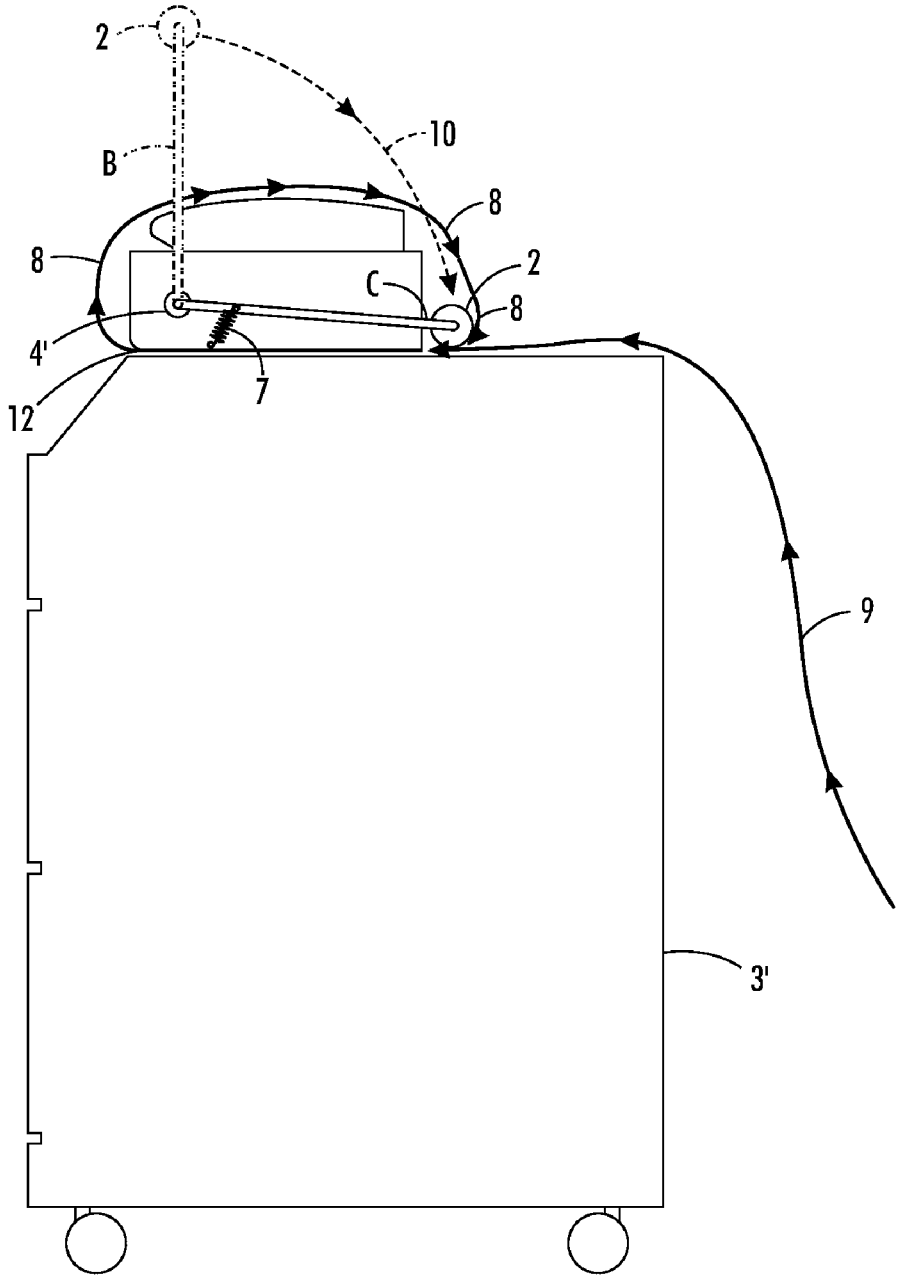
FIG. 2 is a side plan view of the embodiment of FIG. 1 which shows the direction of the paper being handled into and out of the scanner.

In FIG. 2 a simplified side view of an embodiment of the paper handling system of this invention is shown for ease of understanding. A printer with a printer housing 3' has on its top portion a scanner 4' with the take-up roller being shown in a disengaged position B and movable (downward as arrows 10 show) to an engaged position as shown at C. As paper shown at arrow 9 is pulled into the paper input of the scanner 4', it contacts take-up roller 2 and causes take-up roller 2 to turn in a paper roll collecting fashion. The paper exiting the scanner 4' as shown at arrows 8 continues to be wound around take-up roller 2.

Figure 3:
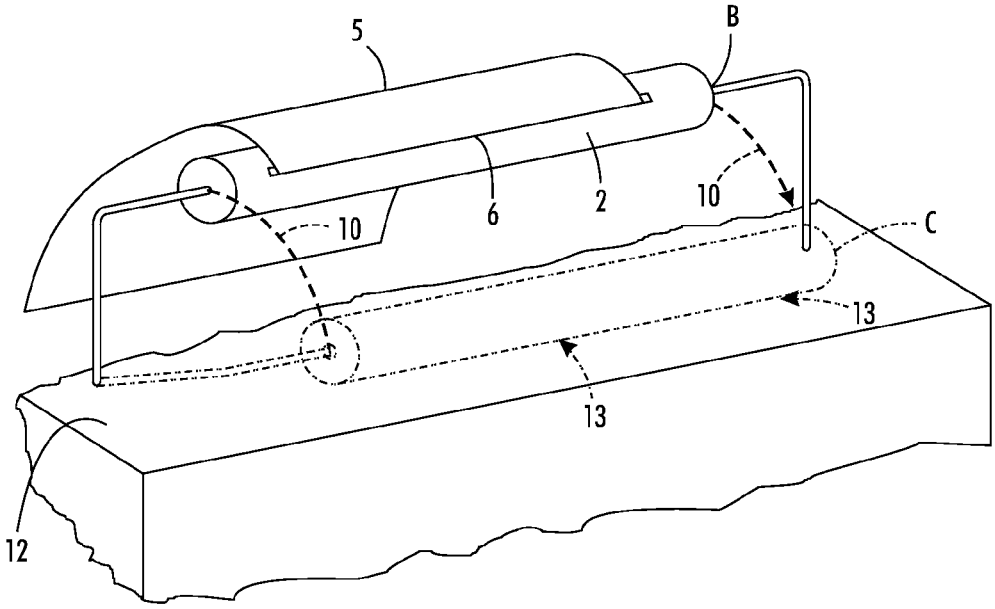
FIG. 3 is a perspective view of the spring-loaded friction drive as it is in the disengaged and engaged positions.

FIG. 3 shows an enlarged illustration of the take-up roller 2 with a slot 6 for easily connecting paper 5 thereto. The scanner 4,4' and spring mechanism 7 are not shown in this FIG. 3 for clarity and ease of understanding. Shown is paper 5 being connected to take-up roller 2 via slot 6 when roller 2 is in a disengaged position B. The take-up roller 2 is then manually rotated clockwise until the paper 5 is firmly connected thereto. Once the paper is connected, the take-up roller 2 is moved down as shown by lines 10 into an engaged position shown at C. Swivel arms 11 are used to pivot the take-up roller 2 to an engaged position C. Once take-up roller 2 is in the engaged position, it contacts paper being fed between the scanner (not shown) and the top 12 of housing 3 as shown by arrows 13. Any suitable springs may be used to ensure the take-up roller 2 snaps in place when moved from position B (disengaged) to position C (engaged).

Figure 4:
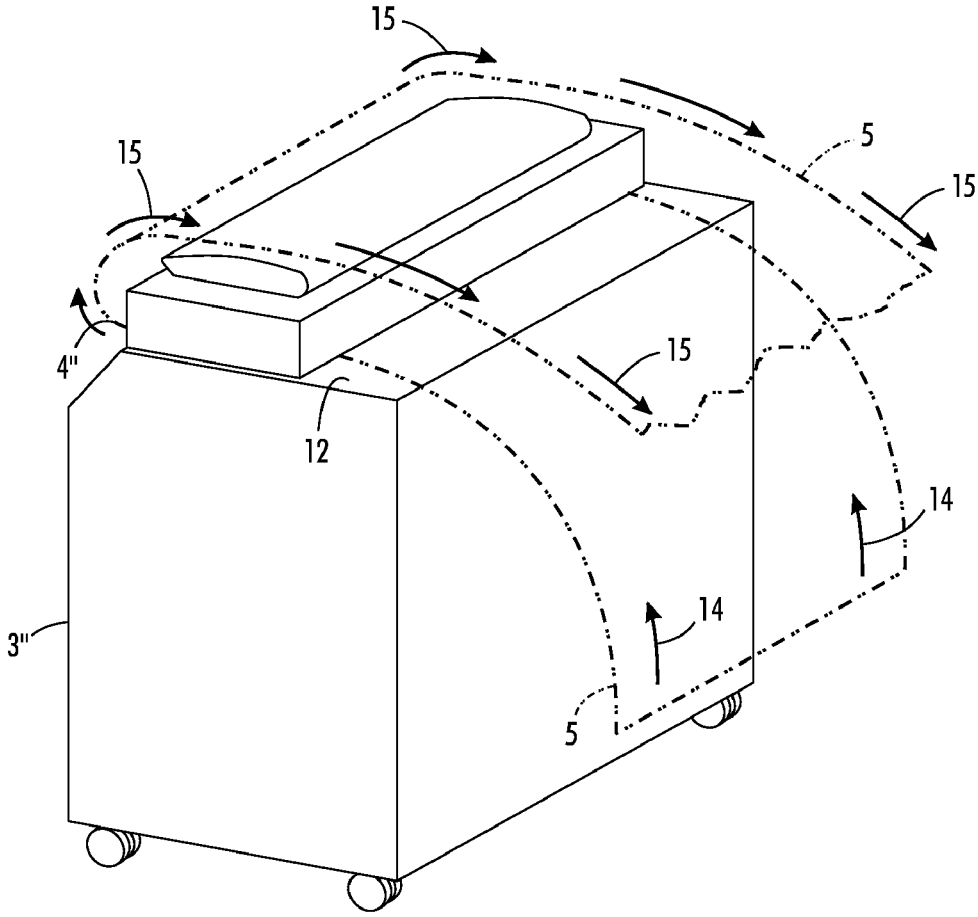
FIG. 4 PRIOR ART
FIG. 4 is a perspective view of a prior art paper-handling system in a marking apparatus.

A prior art paper handling system is shown in FIG. 4 where paper 5 is fed shown by arrow 14 to a scanner 4" and exits scanner 4" as shown by arrows 15 to be laid on the floor or manually folded on top 12 of housing 3". Without any better control of the exiting paper at 15, the paper could easily curl or become damaged.

In summary, one embodiment of this invention provides a paper handling system comprising a paper feed input, a paper processing structure having a paper pulling configuration with a paper input and paper exit, a paper output positioned in the system subsequent to the paper processing structure, and a paper take-up roller. This paper take-up roller is configured to be movable in a disengaged position and also in an engaged position. The paper take-up roller is configured to be connected to paper from the paper exit when the take-up roller is in the disengaged position. The paper take-up roller is configured to be moved to the engaged position where it contacts and is rotated or moved by paper being pulled by the paper processing structure. The paper take-up roller is configured thereby to rotatably collect paper exiting the processing structure.

In another embodiment, this paper processing structure is an image scanner, and the image scanner is located in communication with a paper marking apparatus. The paper processing structure in a preferred embodiment is a scanner positioned in communication with an electrophotographic marking apparatus.

Another embodiment which is preferred provides a paper marking system comprising a marking apparatus and marking housing, a scanner positioned on top of the marking housing, and having a paper pulling structure, and a paper collection assembly. The scanner has a paper feed input and a paper exit configured to discharge scanned paper. The paper collection assembly comprises a take-up roller configured to be attached to and collect paper from the paper exit. The take-up roller is configured to be moved into a disengaged position and into an engaged position. The take-up roller when in the engaged position is configured to be moved by paper entering the paper feed input. The paper entering the paper feed input is movable by the paper pulling structure of the scanner. The take-up roller is configured to continuously and rotatably collect paper exiting the scanner. The take-up roller is spring loaded and configured to be moved in the engaged position and set in the disengaged position. The take-up roller when in the disengaged position is located above the scanner, and when in the engaged position, is located in front of and above the paper feed input. The take-up roller is configured to be in rotatable contact with paper entering the paper feed input and is configured to be powered thereby. The take-up roller is rotatably moved by the pulling structure of the scanner together with movement of paper entering the paper feed input of the scanner.

In another preferred embodiment, a wide format electrophotographic marking system is provided comprising a printer having a printer housing, a scanner position on top of the printer housing and a take-up roller assembly movably positioned in cooperation with the scanner. The scanner has a paper feed input and a paper output and a paper pulling structure configured to continuously pull paper into the paper feed input. The scanner is configured to exit paper from the paper output after the scanning step. The take-up roller assembly is configured to be connected to and collect paper after it exits the paper output. The take-up roller assembly is configured to be driven by the movement of paper being input into the scanner, this paper being input into the scanner by the paper pulling structure of the scanner. The take-up roller assembly is spring loaded and configured to be moved in the engaged position and set in the disengaged position.

The paper take-up roller assembly in a preferred embodiment is configured to be connected to the paper only when the assembly is in a disengaged position, and the paper take-up roller assembly is configured to be driven by paper being input into the scanner when the assembly is in an engaged position. As earlier noted, the take-up roller assembly is configured to be driven when it is in contact with moving paper being directed to the paper feed input. The take-up roller assembly is rotatably driven by the paper pulling structure together with movement of paper entering the paper feed input of the scanner.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A paper handling system, comprising:

a paper processing structure that is configured to pull paper between a paper input and a paper exit; and a paper take-up roller configured to be movable between a disengaged position and an engaged position, the paper take-up roller being configured to be connected to paper exiting the paper exit of the paper processing structure when the paper take-up roller is in the disengaged position, and the paper take-up roller being configured to be moved to the engaged position to contact and to be rotated by the paper as the paper is pulled by the paper processing structure, and being configured thereby to rotatably collect the paper exiting the paper processing structure.

2. The system of claim 1, wherein the paper processing structure is an image scanner.

3. The system of claim 1, the system being located in communication with a paper marking apparatus.

4. The system of claim 1, wherein the paper processing structure is a scanner positioned in communication with an electrophotographic marking apparatus.

5. A paper marking system, comprising:

a marking apparatus and a marking housing;

a scanner positioned on top of the marking housing, and configured to pull paper between a paper input and a paper exit; and a paper collection assembly, the paper collection assembly comprising a take-up roller configured to be attached to and to collect paper exiting from the paper exit of the scanner, the take-up roller being configured to be moved between a disengaged position and an engaged position, the take up roller, when in the engaged position, being configured to be rotated by paper being pulled to the paper input of the scanner, and the take-up roller being configured to continuously and rotatably collect paper exiting the paper exit of the scanner.

6. The system of claim 5, wherein the take-up roller is spring loaded and configured to be moved and set in both the engaged position and the disengaged position.

7. The system of claim 5, wherein the take-up roller, when in the disengaged position, is located above said scanner, and when in the engaged position, is located in front of and above the paper input.

8. The system of claim 5, wherein the take-up roller is configured to be in rotatable contact with the paper entering the paper input and to be powered by movement of the paper entering the paper input.

9. The system of claim 5, wherein the take-up roller is rotatably moved by movement of the paper entering the paper input of the scanner.

10. A wide format electrophotographic marking system, comprising:

a printer having a printer housing, a scanner positioned on top of the printer housing, and a take-up roller assembly movably positioned in cooperation with the scanner, the scanner having a paper input and a paper output, the scanner being configured to continuously pull paper into the paper input, the scanner being configured to exit the paper, after a scanning step, from the paper output, the take-up roller assembly being configured to be connected to and collect the paper after the paper exits the paper output, and the take-up roller assembly being configured to be driven by movement of paper being continuously pulled into the paper input the scanner.

11. The system of claim 10, wherein the take-up roller assembly is spring loaded and configured to be moved and set in both a disengaged position and an engaged position.

12. The system of claim 11, wherein the paper take-up roller assembly is configured to be connected to the paper when the take-up roller assembly is in the disengaged position.

13. The system of claim 11, wherein the paper take-up roller assembly is configured to be driven by the paper being continuously pulled into the paper input of the scanner when the take-up roller assembly in the engaged position.

14. The system of claim 10, wherein the take-up roller assembly is configured to be driven when the take-up roller is in contact with moving paper being directed to the paper input of the scanner.

15. The system of claim 10, wherein the take-up roller assembly is rotatably driven by movement of the paper entering the paper input of the scanner.

* * * * *

UNITED STATES PATENT AND TRADEMARK OFFICE

CERTIFICATE OF CORRECTION

PATENT NO. : 8,233,835 B2
APPLICATION NO. : 12/477974
DATED : July 31, 2012
INVENTOR(S) : Craig W. Martin et al.

It is certified that error appears in the above-identified patent and that said Letters Patent is hereby corrected as shown below:

On the Title page, Item (75)

Please correct the spelling of the third inventor's name as follows:

Guido ~~Dimateo~~ DiMatteo

Signed and Sealed this
Twenty-fifth Day of June, 2013

Teresa Stanek Rea
*Acting Director of the United States Patent and Trademark Office*